US010062343B2

(12) United States Patent
Yoshimoto

(10) Patent No.: US 10,062,343 B2
(45) Date of Patent: Aug. 28, 2018

(54) DRIVING CONTROL DEVICE OF ELECTRO-OPTICAL PANEL, ELECTRO-OPTICAL DEVICE, IMAGING APPARATUS, AND DRIVING CONTROL METHOD OF ELECTRO-OPTICAL PANEL

(71) Applicant: SEIKO EPSON CORPORATION, Tokyo (JP)

(72) Inventor: Hiroshi Yoshimoto, Suwa (JP)

(73) Assignee: SEIKO EPSON CORPORATION, Tokyo (JP)

( * ) Notice: Subject to any disclaimer, the term of this patent is extended or adjusted under 35 U.S.C. 154(b) by 94 days.

(21) Appl. No.: 14/911,687

(22) PCT Filed: Aug. 11, 2014

(86) PCT No.: PCT/JP2014/004166
§ 371 (c)(1),
(2) Date: Feb. 11, 2016

(87) PCT Pub. No.: WO2015/022776
PCT Pub. Date: Feb. 19, 2015

(65) Prior Publication Data

US 2016/0300540 A1 Oct. 13, 2016

(30) Foreign Application Priority Data

Aug. 14, 2013 (JP) ..... 2013-168498

(51) Int. Cl.
*G09G 3/36* (2006.01)

(52) U.S. Cl.
CPC ..... *G09G 3/3648* (2013.01); *G09G 3/3685* (2013.01); *G09G 2330/026* (2013.01); *G09G 2330/027* (2013.01)

(58) Field of Classification Search
CPC ..... G09G 3/36
See application file for complete search history.

(56) References Cited

U.S. PATENT DOCUMENTS 6,091,450 A 7/2000 Hirasawa
6,151,016 A 11/2000 Kanbe et al.
(Continued)

FOREIGN PATENT DOCUMENTS

JP S63-304228 A 12/1988
JP 02-272490 A 11/1990
(Continued)

*Primary Examiner* — Sanghyuk Park
(74) *Attorney, Agent, or Firm* — Maschoff Brennan

(57) ABSTRACT

A control circuit (600) performs a first process in which it is controlled so that power is supplied to a liquid crystal panel (AA) from a power generation circuit (700), and a second process in which it is controlled so that the liquid crystal panel (AA) is driven based on an internal vertical synchronizing signal (Vs2) of which a frequency is higher than that of an external vertical synchronizing signal (Vs1), and a video center voltage (Dref) is applied to each pixel electrode (6) of the liquid crystal panel (AA), and performs a control so that the liquid crystal panel (AA) is driven based on the external vertical synchronizing signal (Vs1), after repeatedly performing the second process with respect to a plurality of the internal vertical synchronizing signals (Vs2), when a display control signal which instructs displaying of an image on the liquid crystal panel (AA) is supplied.

20 Claims, 7 Drawing Sheets

(56) References Cited

U.S. PATENT DOCUMENTS

| | | | | |
|---|---|---|---|---|
| 6,559,824 | B1 | 5/2003 | Kubota et al. | |
| 2004/0104908 | A1 | 6/2004 | Toyozawa et al. | |
| 2006/0221254 | A1* | 10/2006 | Chang | H04N 5/268 348/706 |
| 2008/0094335 | A1* | 4/2008 | Kim | G09G 3/3611 345/89 |
| 2008/0117224 | A1 | 5/2008 | Kimura | |
| 2008/0158126 | A1* | 7/2008 | Tung | G09G 3/3648 345/92 |
| 2012/0133635 | A1* | 5/2012 | Ji | G09G 3/3688 345/212 |
| 2013/0083228 | A1 | 4/2013 | Iwatani | |

FOREIGN PATENT DOCUMENTS

| | | | |
|---|---|---|---|
| JP | 09-269476 | A | 10/1997 |
| JP | 2001-159877 | A | 6/2001 |
| JP | 2005-134458 | A | 5/2005 |
| JP | 2005-227629 | A | 8/2005 |
| JP | 2006-279360 | A | 10/2006 |
| JP | 2008-129351 | A | 6/2008 |
| JP | 2009-271392 | A | 11/2009 |
| JP | 2010-008541 | A | 1/2010 |
| JP | 2010-175681 | A | 8/2010 |
| JP | 2012-22160 | A | 2/2012 |
| WO | 2015/022776 | A1 | 2/2015 |

* cited by examiner

[Fig. 1]
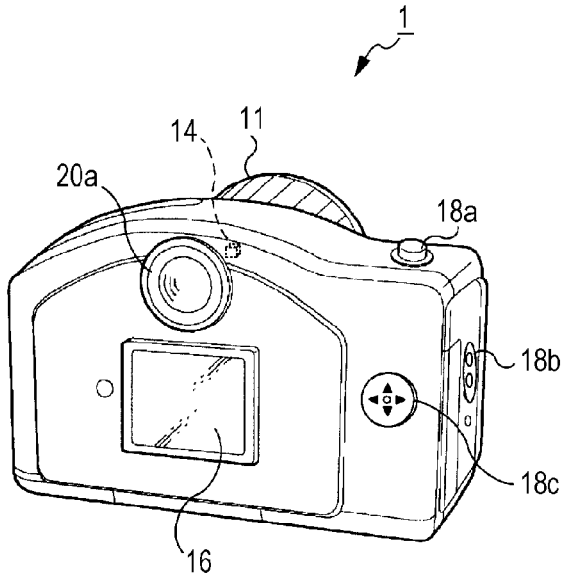
[Fig. 2]
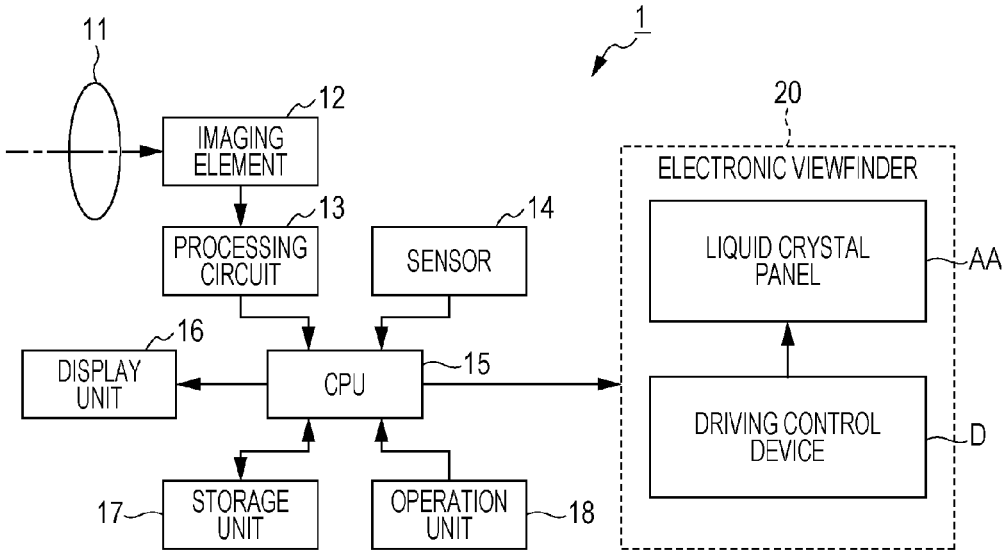

[Fig. 3]
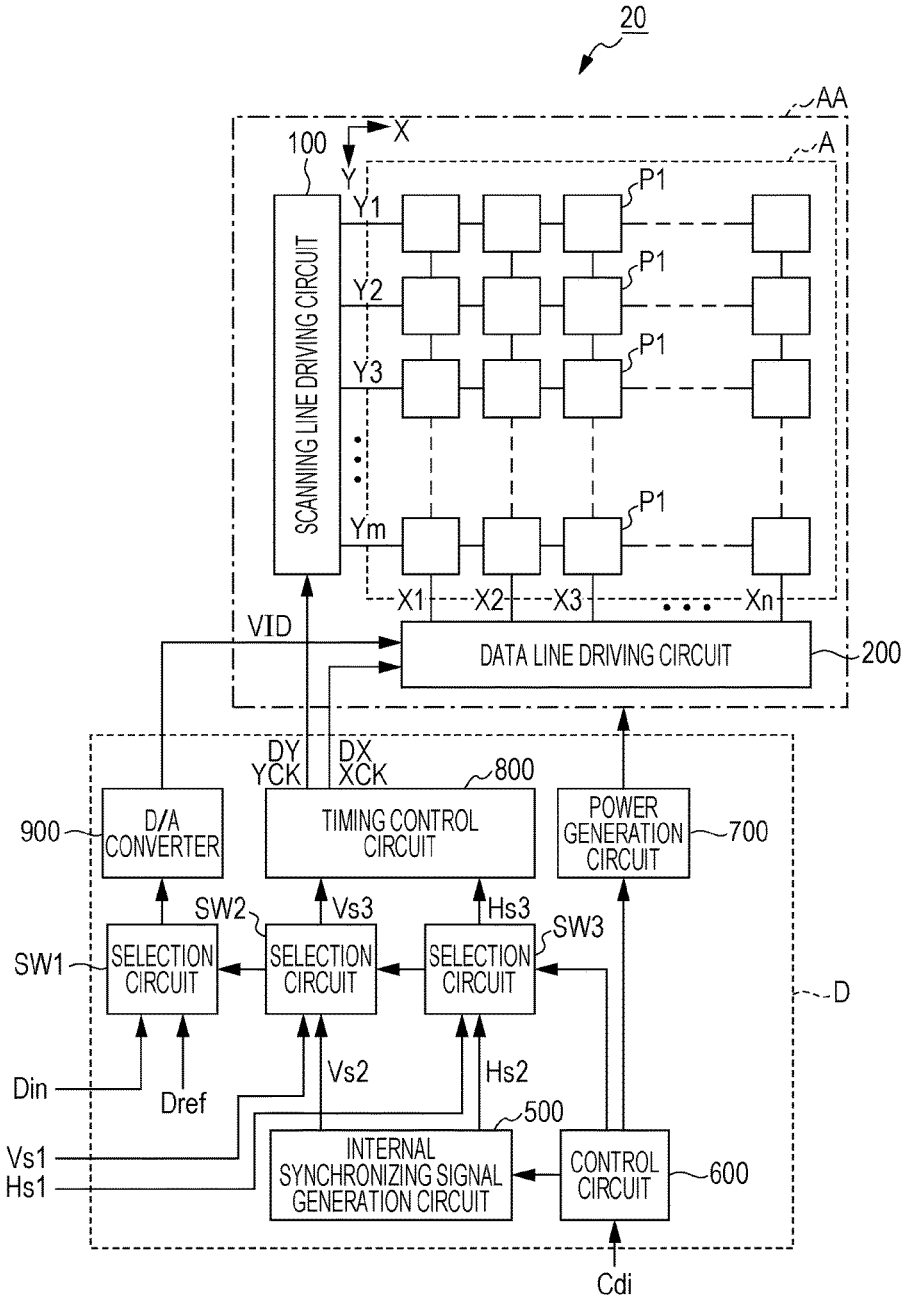

[Fig. 4]
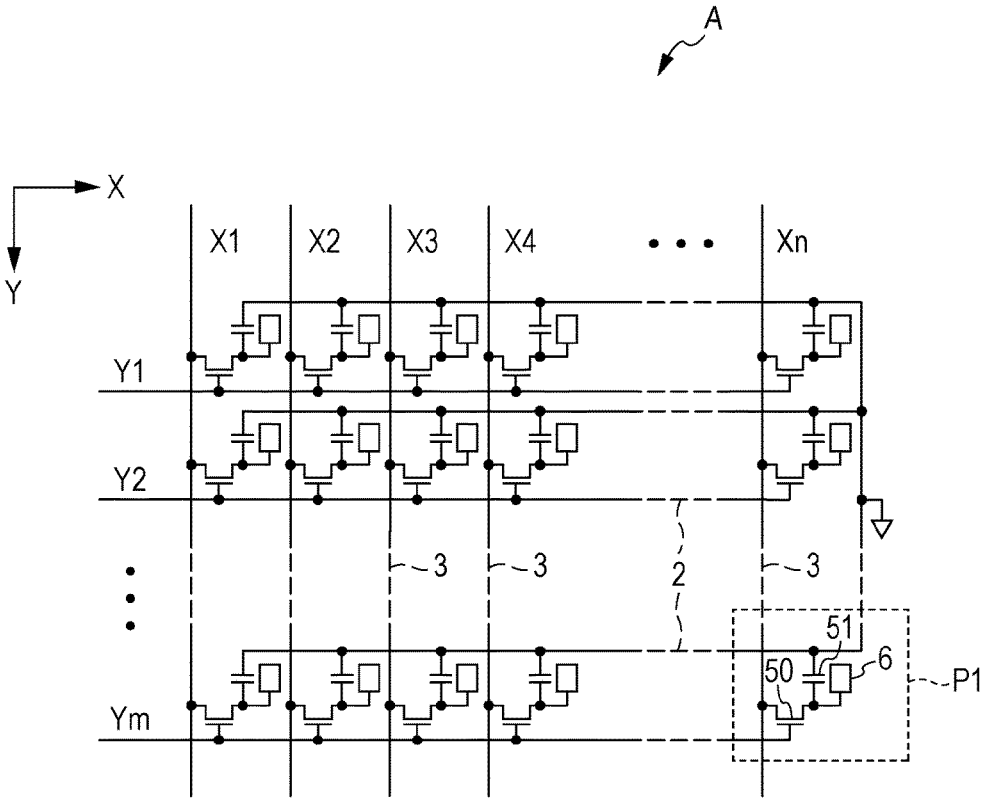

[Fig. 5]
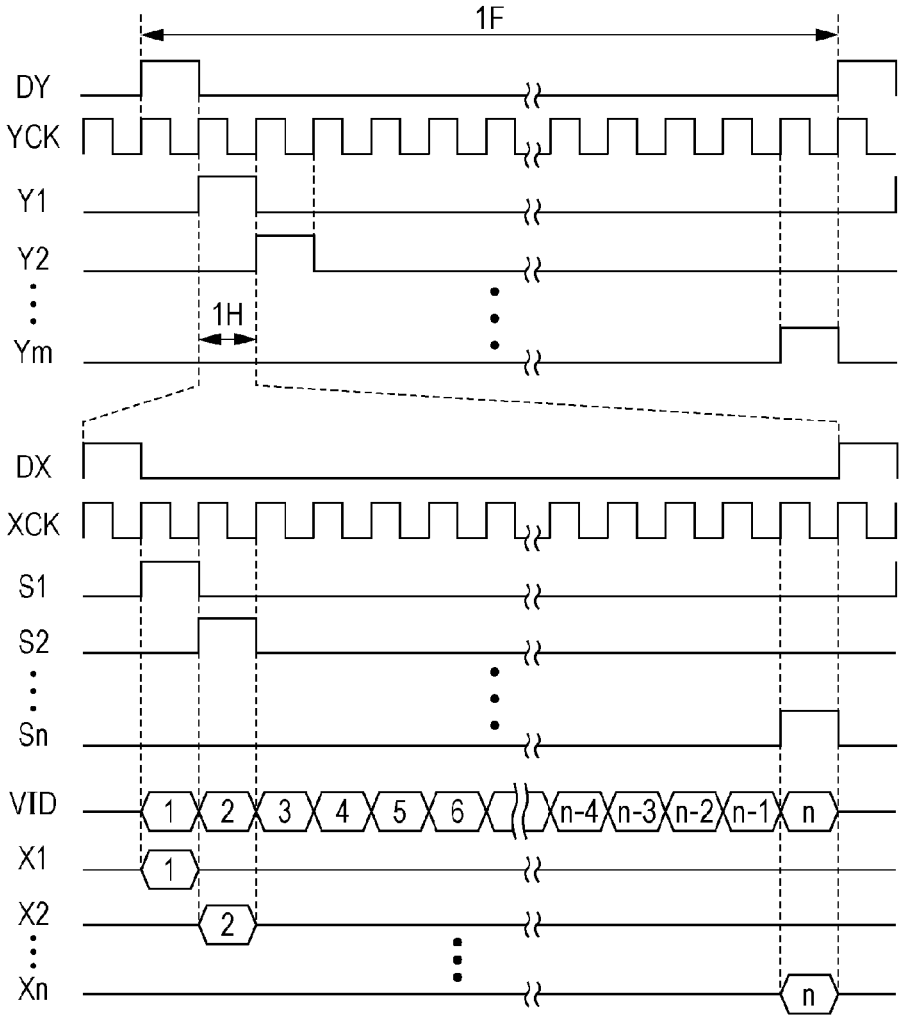

[Fig. 6]
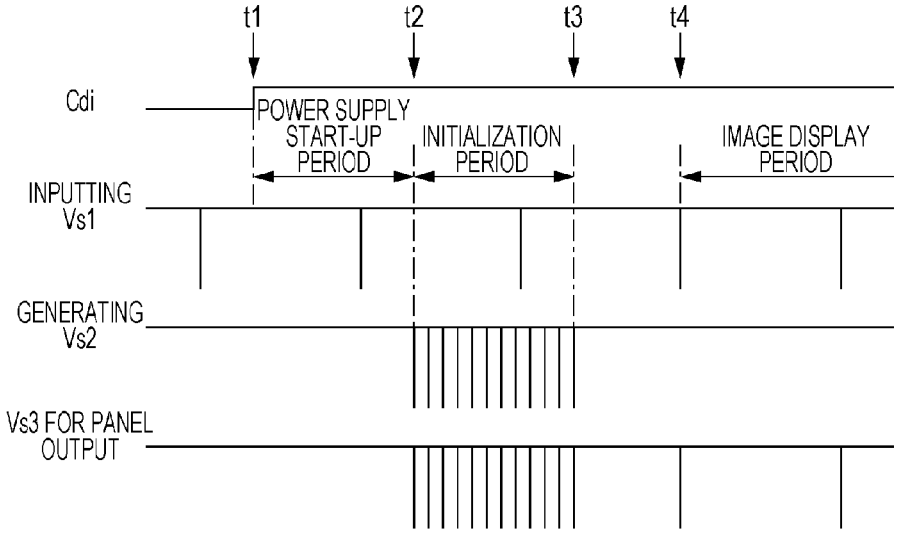
[Fig. 7]
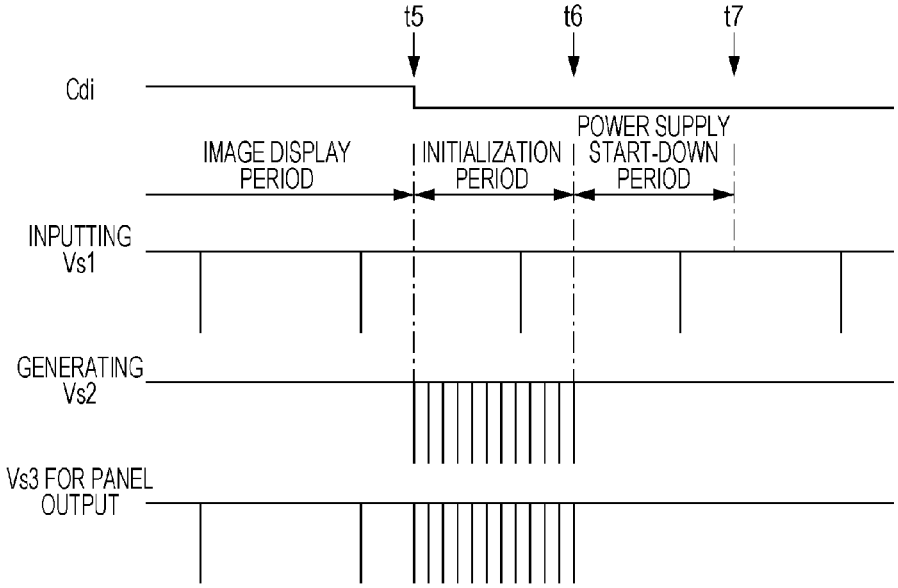

[Fig. 8]
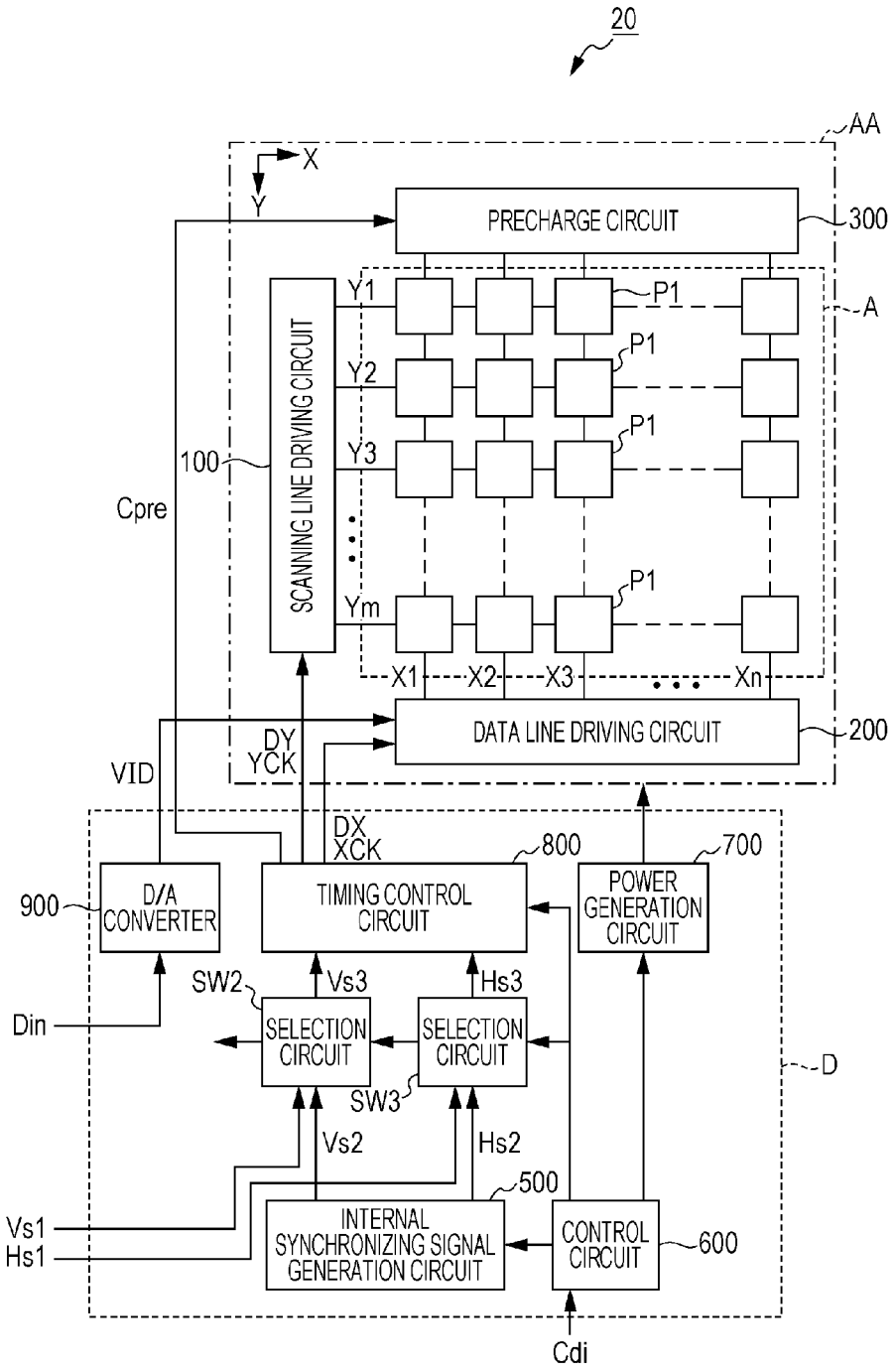

[Fig. 9]
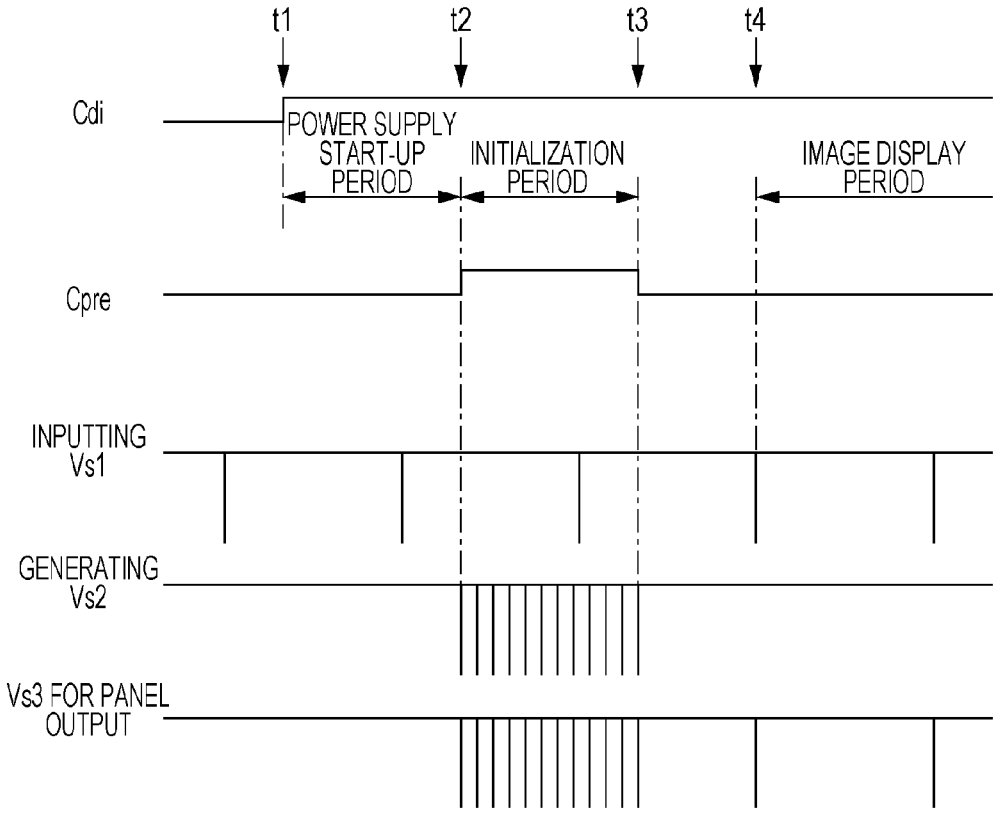

DRIVING CONTROL DEVICE OF ELECTRO-OPTICAL PANEL, ELECTRO-OPTICAL DEVICE, IMAGING APPARATUS, AND DRIVING CONTROL METHOD OF ELECTRO-OPTICAL PANEL

TECHNICAL FIELD

The present invention relates to a driving control device for controlling driving of an electro-optical panel, an electro-optical device, an imaging apparatus, and a driving control method of the electro-optical panel.

BACKGROUND ART

An imaging apparatus which is provided with an imaging element includes a display device so that a user can confirm an image which is a recording target (for example, refer to PTL 1). In the imaging apparatus, a driving frequency (clock frequency) of a CPU which controls the entire apparatus is set according to a required operation. In particular, it is possible to initialize a memory, or the like, at a high speed by increasing the driving frequency at a time of power supply.

As such an imaging apparatus, there is an apparatus which includes an electronic view finder (EVF) of a look-in type. The EVF includes a liquid crystal panel (example of electro-optical panel), and displays an image based on a vertical synchronizing signal from a camera on the liquid crystal panel.

CITATION LIST

Patent Literature

PTL 1: JP-A-2006-279360

SUMMARY OF INVENTION

Technical Problem

Meanwhile, when a liquid crystal panel is used in a display device, in general, an initializing process of applying a predetermined voltage (for example, zero) to the liquid crystal before displaying an imaged image of a camera is performed over a plurality of fields, in order to prevent ghosting.

However, there has been a problem in that it is not possible to display an image until the initializing process ends, even when power in input, and there is a time lag between the power input and displaying of an image, since a predetermined voltage which is irrelevant to an image to be displayed is applied during the initializing process of a liquid crystal panel. In addition, in an imaging apparatus which is described in PTL 1, though a driving frequency of a CPU is increased right after the power input, a technology of increasing a frequency of a vertical synchronizing signal of the liquid crystal panel in conjunction with the driving frequency of the CPU is not disclosed, and thus, there has been the same problem.

The present invention has been made by taking such a problem into consideration, and an object thereof is to provide a driving control device of an electro-optical panel, or the like, in which a time for initializing the electro-optical panel can be shortened.

Solution to Problem

In order to solve the above described problem, according to an aspect of the present invention, there is provided a driving control device of an electro-optical panel which controls driving of the electro-optical panel based on an external vertical synchronizing signal which is supplied from outside. The device includes a power supply unit which supplies power to the electro-optical panel; an internal vertical synchronizing signal supply unit which generates an internal vertical synchronizing signal of which a frequency is higher than that of the external vertical synchronizing signal, and outputs the signal; and a control unit, in which the control unit performs a first process in which, when a display control signal which instructs displaying of an image on the electro-optical panel is supplied, it is controlled so that power is supplied to the electro-optical panel from the power supply unit, and a second process in which it is controlled so that the electro-optical panel is driven based on the internal vertical synchronizing signal, and a predetermined voltage is applied to each pixel electrode of the electro-optical panel, and the electro-optical panel is driven based on the external vertical synchronizing signal after repeatedly performing the second process with respect to a plurality of the internal vertical synchronizing signals.

According to the aspect, a horizontal scanning time is shortened compared to a case in which the electro-optical panel is driven according to the external vertical synchronizing signal, since the electro-optical panel is driven based on the internal vertical synchronizing signal of which the frequency is higher than that of the external vertical synchronizing signal, when the display control signal which instructs displaying of the image on the electro-optical panel is supplied. That is, a time needed before displaying an image on the electro-optical panel, that is, a time needed for initializing the electro-optical panel is shortened when using the internal vertical synchronizing signal instead of the external vertical synchronizing signal.

In addition, according to another aspect of the present invention, there is provided a driving control device of an electro-optical panel which controls driving of the electro-optical panel based on an external vertical synchronizing signal which is supplied from outside. The device includes a power supply unit which supplies power to the electro-optical panel; an internal vertical synchronizing signal supply unit which generates an internal vertical synchronizing signal of which a frequency is higher than that of the external vertical synchronizing signal, and outputs the signal; and a control unit, in which, when a display control signal which instructs ending of a display of an image on the electro-optical panel is supplied in a case in which a driving unit performs a control so that the electro-optical panel is driven based on the external vertical synchronizing signal, the control unit repeats a third process, in which the electro-optical panel is controlled so as to be driven based on the internal vertical synchronizing signal, and a predetermined voltage is applied to each pixel electrode of the electro-optical panel, with respect to a plurality of the internal vertical synchronizing signals, and performs a control so that supplying of power to the electro-optical panel from the power supply unit is stopped thereafter.

According to the aspect, since the electro-optical panel is controlled to be driven based on the internal vertical synchronizing signal of which the frequency is higher than that of the external vertical synchronizing signal when the display control signal which instructs ending of the display of the image on the electro-optical panel is supplied, a horizontal scanning time is shortened compared to a case in which the electro-optical panel is driven according to the external vertical synchronizing signal, and in addition, a horizontal scanning period in the whole electro-optical panel is shortened. That is, when using the internal vertical synchronizing signal, a time needed until the power supply is stopped after ending the display of the image on the electro-optical panel, that is, a time needed in the initializing process after ending the display of the electro-optical panel is shortened.

In the driving control device, the frequency of the internal vertical synchronizing signal may be equal to or greater than ten times, or equal to or smaller than twenty times that of the external vertical synchronizing signal. According to the aspect, it is possible to shorten the time until the image is displayed on the electro-optical panel after inputting power, or a time until the supply of power is stopped after ending the display of the image while securing a time needed in reliable writing of a predetermined voltage, by setting the frequency of the internal vertical synchronizing signal to be equal to or greater, or equal to or smaller than that of the external vertical synchronizing signal by a predetermined number of times.

In addition, in the driving control device, the frequency of the internal vertical synchronizing signal may be variable. Here, "variable" includes, for example, a case in which the frequency of the internal vertical synchronizing signal after the inputting of power is monotonously decreased so as to be close to the frequency of the external vertical synchronizing signal, or, on the contrary, a case in which the frequency of the internal vertical synchronizing signal is monotonously increased from the state of being close to the frequency of the external vertical synchronizing signal, after ending the display of the image, or a case in which the frequency of the internal vertical synchronizing signal is increased or decreased according to a rule. According to the aspect, since a period of writing a predetermined voltage for each field in an initializing period is set to be different, the predetermined voltage is reliably applied in a relatively long horizontal scanning period, and, on the other hand, it is possible to shorten a time needed in the initializing process as a whole, by providing a short scanning period.

In addition, in the driving control device, the predetermined voltage may be a voltage in which a potential difference between each of the pixel electrode and a counter electrode thereof becomes zero. According to the aspect, since a voltage which is applied to liquid crystal molecules becomes zero in a case in which the electro-optical panel is a liquid crystal panel, for example, it is possible to initialize an aligning state of the liquid crystal molecules of the liquid crystal panel, and to prevent ghosting.

In addition, in the driving control device, a precharge circuit may be connected to the electro-optical panel, and in the second process, the control unit may apply the predetermined voltage to each pixel electrode of the electro-optical panel from the precharge circuit. According to the aspect, it is possible to collectively apply voltages since the precharge circuit is used in the initializing process of the electro-optical panel.

In addition, the present invention is not limited to the aspects of the driving control device of an electro-optical panel, and can be considered as an electro-optical device which includes an electro-optical panel, and the driving control device of an electrooptical panel according to any one of the above described aspects.

In addition, according to still another aspect of the present invention, there is provided a driving control method of an electro-optical panel which controls driving of the electro-optical panel based on an external vertical synchronizing signal which is supplied from outside. The method includes performing a first process in which it is controlled so that power is supplied to the electro-optical panel, and a second process in which it is controlled so that the electro-optical panel is driven based on the internal vertical synchronizing signal of which the frequency is higher than that of the external vertical synchronizing signal, and a predetermined voltage is applied to each pixel electrode of the electro-optical panel when a display control signal which instructs displaying of an image on the electro-optical panel is supplied, and performing a control so that the electro-optical panel is driven based on the external vertical synchronizing signal after repeatedly performing the second process with respect to a plurality of the internal vertical synchronizing signals.

In addition, according to still another aspect of the present invention, there is provided a driving control method of an electro-optical panel which controls driving of the electro-optical panel based on an external vertical synchronizing signal which is supplied from outside, the method includes repeating a third process of controlling so that the electro-optical panel is driven based on an internal vertical synchronizing signal of which a frequency is higher than that of the external vertical synchronizing signal, and controlling so that a predetermined voltage is applied to each pixel electrode of the electro-optical panel, with respect to a plurality of the internal vertical synchronizing signals, and performing a control so that supplying of power to the electro-optical panel is stopped thereafter, when a display control signal which instructs ending of a display of an image on the electro-optical panel is supplied, in a case in which a control is performed so that the electro-optical panel is driven based on the external vertical synchronizing signal.

In addition, according to still another aspect of the invention, there is provided an imaging apparatus which includes an electronic viewfinder. The apparatus includes an electro-optical panel which is provided in the electronic viewfinder, and displays an imaged image using the imaging apparatus; the driving control device of an electro-optical panel according to any one of the aspects, which is used in driving of the electro-optical panel; an external vertical synchronizing signal supply unit which supplies the external vertical synchronizing signal to the driving control device in synchronization with data of the imaged image; and a sensor which detects a use state or a non-use state of the electronic viewfinder, in which the display control signal is a detection signal of the sensor, instructs displaying of an image on the electro-optical panel when the detection signal detects use of the electronic viewfinder, and instructs ending of the display of the image on the electro-optical panel when the detection signal detects non-use of the electronic viewfinder.

According to the aspect, when the electronic viewfinder is used, the second process is executed due to detecting of the use of the electronic viewfinder, and accordingly, it is possible to shorten a time until an image is displayed on the electro-optical panel.

BRIEF DESCRIPTION OF DRAWINGS

FIG. 1 is a perspective view of an appearance of a digital camera 1 according to a first embodiment of the present invention which is viewed from the rear side.

FIG. 2 is a block diagram which illustrates an example of the entire configuration of the digital camera 1.

FIG. 3 is a block diagram which illustrates an example of a configuration of an electronic viewfinder 20.

FIG. 4 is a circuit diagram which illustrates an example of a configuration of an image display region A in a liquid crystal panel AA.

FIG. 5 is a timing chart which illustrates an example of operations of a scanning line driving circuit 100 and a data line driving circuit 200.

FIG. 6 is a timing chart which describes a supply timing of a vertical synchronizing signal according to the embodiment.

FIG. 7 is another timing chart which describes a supply timing of the vertical synchronizing signal according to the embodiment.

FIG. 8 is a block diagram which illustrates an example of a configuration of an electronic viewfinder 20A according to a second embodiment of the present invention.

FIG. 9 is a timing chart which describes a supply timing of a vertical synchronizing signal according to the embodiment.

DESCRIPTION OF EMBODIMENTS

First Embodiment

FIG. 1 is a perspective view of an appearance of a digital camera 1 (imaging apparatus) according to a first embodiment of the present invention which is viewed from the rear side, and FIG. 2 is a block diagram which illustrates an example of the entire configuration of the digital camera 1.

As illustrated in FIGS. 1 and 2, the digital camera 1 includes a lens 11, an imaging element 12, a processing circuit 13, a display unit 16, a storage unit 17, an operation unit 18, and a CPU 15 which controls each unit. The imaging element 12 is an element which receives an optical image from an object which is captured by the lens 11, and converts the optical image into an electric signal, and the processing circuit 13 is a unit which converts the electric signal which is output from the imaging element 12 into a digital image signal. A digital image is sent to the display unit 16, the storage unit 17, a memory card (not shown), or the like, and is processed under a control of the CPU 15.

The display unit 16 is a liquid crystal display (LCD) unit which is arranged on the rear surface of the digital camera 1, displays a viewed image (imaged image) of an object when performing photographing, or is used when reproducing and displaying an imaged image which is recorded in a memory card.

The storage unit 17 includes a non-volatile memory (for example, flash memory), and a volatile memory (for example, RAM: Random Access Memory). A camera program for causing the camera to operate various operations, or the like, is stored in the former, and the latter is used as a work area of the CPU 15.

The operation unit 18 includes a release button 18*a*, a power button 18*b*, a cursor button/decision button 18*c*, and other operation buttons (not shown), and the CPU 15 performs various controls such as an ON/OFF control of power, or switching of a display image on the display unit 16, based on instructions using various buttons.

An eyepiece unit 20*a* for a photographer to look-in is provided on the rear surface of the digital camera 1, and a sensor 14 and an electronic viewfinder (EVF) 20 are provided in a main body which corresponds to the eyepiece unit 20*a*. The EVF 20 includes a liquid crystal panel AA as an image display unit for EVF, and a driving control device D which drives the liquid crystal panel AA.

The sensor 14 is an infrared sensor, for example, and the CPU 15 detects a use state of the EVF 20 when the sensor 14 detects looking-in of the eyepiece unit 20*a* by the photographer. When the sensor 14 detects the use state of the EVF 20, the CPU 15 switches a display control signal Cdi to an H level. In addition, when looking-in by the photographer is not detected over a predetermined amount of time, the sensor 14 detects a non-use state of the EVF 20. When the sensor 14 detects the non-use state of the EVF 20, the CPU 15 switches the display control signal Cdi to an L level.

In the liquid crystal panel AA, an element substrate in which a thin film transistor (hereinafter, referred to as "TFT") is formed as a switching element and a counter substrate are caused to face (an electrode forming face) each other, are attached with a fixed gap therebetween, and liquid crystals are filled in a space thereof. The liquid crystal panel AA is a transmission type, however, the liquid crystal panel may be a transflective type. FIG. 3 illustrates a specific configuration example of the EVF 20.

As illustrated in the figure, the liquid crystal panel AA includes a image display region A, a scanning line driving circuit 100, and a data line driving circuit 200 on the element substrate thereof. A plurality of pixel circuits P1 are formed in a matrix in the image display region A, and it is possible to control transmittivity in each pixel circuit P1. Light from a backlight which is not illustrated is output through the pixel circuit P1. In this manner, it is possible to perform a gradation display using light modulation.

As illustrated in FIG. 4, m (m is a natural number of 2 or more) scanning lines 2 are formed by being arranged in parallel along the X direction, and on the other hand, n (n is a natural number of 2 or more) data lines 3 are formed by being arranged in parallel along the Y direction, in the image display region A. In addition, a gate of a TFT 50 is connected to the scanning line 2 in the vicinity of an intersection of the scanning line 2 and the data line 3, and on the other hand, a source of the TFT 50 is connected to the data line 3, and a drain of the TFT 50 is connected to a pixel electrode 6. In addition, each pixel is configured of the pixel electrode 6, a counter electrode (to be described later) which is formed on the counter substrate, and liquid crystals which are interposed between both the electrodes. As a result, pixels are arranged in a matrix corresponding to each intersection of the scanning line 2 and the data line 3.

In addition, scanning signals Y1, Y2, . . . , Ym are line sequentially applied to each of the scanning lines 2 to which the gate of the TFT 50 is connected, in a pulse manner. For this reason, when a scanning signal is supplied to a certain scanning line 2, a TFT 50 which is connected to the scanning line is turned on, and accordingly, data signals X1, X2, . . . , Xn which are supplied at a predetermined timing from the data line 3 are written in a corresponding pixel in order, and are maintained for a predetermined period thereafter.

Since the orientation and order of liquid crystal molecules are changed according to a voltage level which is applied to each pixel in pixel circuit P1, it is possible to perform a gradation display using light modulation. For example, since intensity of light which passes through liquid crystals is limited when an applied voltage becomes high, if it is a normally white mode, and on the other hand, is relaxed when the applied voltage becomes high, if it is a normally black mode, light with contrast corresponding to an image signal is output in each pixel of the entire liquid crystal panel AA. For this reason, it is possible to perform a predetermined display.

In addition, in order to prevent leaking of the maintained image signal, a storage capacitor 51 is added in parallel to a liquid crystal capacitor which is formed between the pixel electrode 6 and the counter electrode. For example, since a voltage of the pixel electrode 6 is maintained by the storage capacitor 51 for a longer time than a time of applying a source voltage by a three digit number, it is possible to realize a high contrast ratio as a result of improving a maintaining property.

Subsequently, the driving control device D will be described. As illustrated in FIG. 3, selection circuits SW1, SW2, and SW3, an internal synchronizing signal generation circuit 500, a power generation circuit 700, a timing control circuit 800, a D/A converter 900, and a control circuit 600 which controls each unit are arranged in the driving control device D. In the driving control device D, a digital image signal Din, an external vertical synchronizing signal Vs1 which is in synchronization with the digital image signal, and an external horizontal synchronizing signal Hs1 are input from the outside (that is, CPU 15) of the driving control device D, and are supplied to the selection circuits SW1, SW2, and SW3, respectively. In addition, the display control signal Cdi from the CPU 15 is supplied to the control circuit 600.

The power generation circuit 700 supplies power to the liquid crystal panel AA under a control of the control circuit 600 when the display control signal Cdi becomes an H level. On the contrary, when the display control signal Cdi becomes an L level, the power generation circuit stops supplying of power to the liquid crystal panel AA under a control of the control circuit 600. As described above, the CPU 15 switches the display control signal Cdi to an H level when detecting a use state of the EVF 20 using the sensor 14. That is, when the display control signal Cdi of instructing displaying of an image on the liquid crystal panel AA is supplied, the control circuit 600 performs the first process in which a control is performed so that power is supplied to the liquid crystal panel AA from the power generation circuit 700.

The internal synchronizing signal generation circuit 500 generates an internal vertical synchronizing signal Vs2 of which a frequency is higher than that of an external vertical synchronizing signal Vs1, and supplies the signal to the selection circuit SW2, and generates an internal horizontal synchronizing signal Hs2 of which a frequency is higher than that of an external horizontal synchronizing signal Hs1, and supplies the signal to the selection circuit SW2.

The EVF 20 performs a control so that power is supplied to the liquid crystal panel AA, and an image is displayed only when a photographer performs looking-in of the eyepiece unit 20*a* (that is, only when a use state is detected by the sensor 14) in order to reduce power consumption. However, the liquid crystal panel AA does not display an image corresponding to the digital image signal Din which is supplied from the camera right after a supply of power, and performs a process of initializing an aligning state of each liquid crystal molecule in the image display region A, before displaying the image. In the initializing process, a predetermined voltage (video center voltage Dref) which is unrelated to an imaged image to be displayed is applied to each pixel electrode 6. An object thereof is to recover the aligning state of the liquid crystal molecule to an initial state in which a voltage is not applied to the liquid crystal (a potential difference between the pixel electrode and the counter electrode is zero), by applying the video center voltage Dref.

According to the embodiment, when performing the initializing process, the video center voltage Dref is applied based on the internal vertical synchronizing signal Vs2 which is generated in the liquid crystal panel AA, instead of the external vertical synchronizing signal Vs1 which is supplied from the CPU 15 of the camera. As described above, since the frequency of the internal vertical synchronizing signal Vs2 is set to be higher than that of the external vertical synchronizing signal Vs1, it is possible to shorten a time necessary for the initializing process compared to a case in which a timing control is performed based on the external vertical synchronizing signal Vs1 as a result of shortening a vertical scanning period in which the entire screen is scanned. Therefore, according to the driving control device D according to the embodiment, it is possible to shorten a time until a display of an imaged image is started, after supplying of power to the liquid crystal panel AA.

The frequency of the internal vertical synchronizing signal Vs2 is preferably set to equal to or greater than ten times, or equal to or smaller than twenty times the frequency of the external vertical synchronizing signal Vs1. By setting the frequency of the internal vertical synchronizing signal Vs2 to be equal to or greater than, or equal to or smaller than that of the external vertical synchronizing signal Vs1 by a predetermined number of times, it is possible to remarkably shorten a time until an imaged image is displayed on the liquid crystal panel after inputting of power, or a time until supplying of power is stopped after ending of the display of the imaged image while securing a time necessary for writing of the video center voltage Dref.

The video center voltage Dref is supplied to the selection circuit SW1, in addition to the digital image signal Din which is input from the CPU 15 of the camera. The video center voltage Dref is a voltage of which a potential difference between the pixel electrode 6 and the counter electrode becomes zero, and is supplied to the data line driving circuit 200 in the initialization period of the liquid crystal panel AA. That is, the control circuit 600 performs a control so that the selection circuit SW1 is switched, and the video center voltage Dref is output from the selection circuit SW1 in the initialization period. On the other hand, the control circuit 600 performs a control so that the selection circuit SW1 is switched, and the digital image signal Din is output from the selection circuit SW1, in the image display period. The D/A converter 900 converts the supplied digital image signal Din or video center voltage Dref into an analog signal, and supplies the signal to the data line driving circuit 200 as an image signal VID.

The timing control circuit 800 generates an X transfer start pulse DX, and an X clock signal XCK based on the internal vertical synchronizing signal Vs2 and the internal horizontal synchronizing signal Hs2 which are supplied from the internal synchronizing signal generation circuit 500, and supplies the signals to the data line driving circuit 200, and generates a Y transfer start pulse DY, and a Y clock signal YCK, and supplies the signals to the scanning line driving circuit 100 in the initialization period. In this case, the control circuit 600 performs a control so that the internal vertical synchronizing signal Vs2 is output from the selection circuits SW2 as a panel output signal Vs3, and the internal horizontal synchronizing signal Hs2 is output from the selection circuit SW3 as a panel output signal Hs3, by switching the selection circuits SW2 and SW3.

On the other hand, the timing control circuit 800 generates the X transfer start pulse DX, and the X clock signal XCK based on the external vertical synchronizing signal Vs1 and the external horizontal synchronizing signal Hs1, and supplies the signals to the data line driving circuit 200, and generates the Y transfer start pulse DY, and the Y clock signal YCK, and supplies the signals to the scanning line driving circuit 100 in the image display period. In this case, the control circuit 600 performs a control so that the external vertical synchronizing signal Vs1 is output from the selection circuits SW2, and the external horizontal synchronizing signal Hs1 is output from the selection circuit SW3, by switching the selection circuits SW2 and SW3.

FIG. 5 illustrates a timing chart of the scanning line driving circuit 100 and the data line driving circuit 200. The scanning line driving circuit 100 generates the scanning signals Y1, Y2, . . . , Ym by sequentially shifting the Y transfer start pulse DY of one frame period (1F) according to the Y clock signal YCK. The scanning signals Y1 to Ym become sequentially active in each horizontal scanning period (1H). The data line driving circuit 200 internally generates sampling signals S1, S2, . . . , Sn by transferring the X transfer start pulse DX in the horizontal scanning period according to the X clock signal XCK. In addition, the data line driving circuit 200 generates the data signals X1, X2, . . . , Xn by sampling an image signal VID using the sampling signals S1, S2, . . ., Sn.

FIGS. 6 and 7 are timing charts which describe a supply timing of the vertical synchronizing signal according to the embodiment. FIG. 6 is a timing chart when the display control signal Cdi is switched to an H level from an L level (hereinafter, for ease of description, referred to as "ON sequence" in some cases), and FIG. 7 is a timing chart when the display control signal Cdi is switched to the L level from the H level (hereinafter, for ease of description, referred to as "OFF sequence" in some cases). As described above, the display control signal Cdi instructs starting of a display of an image on the liquid crystal panel AA by being switched to the H level from the L level when detecting looking-in of the eyepiece unit 20*a* of the EVF 20 by a photographer using the sensor 14, and on the other hand, the display control signal instructs ending of the display of the image on the liquid crystal panel AA by being switched to the L level from the H level when the looking-in operation is not detected over a predetermined amount of time by the sensor 14 in a period in which the display control signal Cdi is the H level. That is, in a case of the former, the display control signal Cdi is a signal which instructs displaying of the image on the liquid crystal panel AA, and in a case of the latter, the display control signal Cdi is a signal which instructs ending of the display of the image on the liquid crystal panel AA.

First, a supply timing of the vertical synchronizing signal in the ON sequence will be described with reference to FIG. 6. As illustrated, the internal vertical synchronizing signal Vs2 is generated in the internal synchronizing signal generation circuit 500 when the display control signal Cdi is switched to an H level from an L level (t1), and a power supply start-up period of the liquid crystal panel AA is ended (t2), and the internal vertical synchronizing signal is supplied to the timing control circuit 800 as a panel output signal Vs3 through the selection circuit SW2. In addition, in the initialization period (t2 to t3), writing of a predetermined voltage of a plurality of times to the image display region A (field) is performed based on the plurality of internal vertical synchronizing signals Vs2. After the initialization period, the external vertical synchronizing signal Vs1 which is firstly input to the selection circuit SW2 is supplied to the timing control circuit 800 as a panel output signal Vs3, and an image display period is started (t4).

That is, the control circuit 600 performs the following first and second processes when the display control signal Cdi is switched to the H level from the L level (t1). The first process is a process of controlling so that power is supplied with respect to the liquid crystal panel AA from the power generation circuit 700. Subsequently, when the power supply of the liquid crystal panel AA is started (t2), the control circuit 600 performs the second process in which the liquid crystal panel AA is driven based on the internal vertical synchronizing signal Vs2 which is output from the internal synchronizing signal generation circuit 500, and the video center voltage Dref is applied to each pixel electrode 6 of the liquid crystal panel AA. The control circuit 600 performs the second process every time the internal vertical synchronizing signal Vs2 is output. That is, the control circuit 600 repeatedly performs the second process with respect to the plurality of internal vertical synchronizing signals Vs2. In addition, the image display process is performed based on the external vertical synchronizing signal Vs1 thereafter (t4).

The number of signals of the internal vertical synchronizing signal Vs2 in the initialization period is arbitrary, however, it is preferable to set the number to a number in which the initialization process can be sufficiently executed. Since the frequency of the internal vertical synchronizing signal Vs2 is set to be higher than that of the external vertical synchronizing signal Vs1, there is a concern that a writing time of a voltage per pixel electrode may become short, and writing may become insufficient. For this reason, it is set such that a sufficient initialization process can be executed as a result by generating the plurality of internal vertical synchronizing signals Vs2, and repeatedly performing writing a plurality of times, even if it is short time writing.

In the initialization period, it is controlled so that the internal vertical synchronizing signal Vs2 which is output from the internal synchronizing signal generation circuit 500 is provided to the timing control circuit 800 as the panel output signal Vs3 through the selection circuit SW2, the internal horizontal synchronizing signal Hs2 which is output from the internal synchronizing signal generation circuit 500 is provided to the timing control circuit 800 as the panel output signal Hs3 through the selection circuit SW3, and the video center voltage Dref is provided to the D/A converter 900 through the selection circuit SW1. The timing control circuit 800 generates the X transfer start pulse DX, and the X clock signal XCK based on the internal vertical synchronizing signal Vs2 and the internal horizontal synchronizing signal Hs2, and supplies the signals to the data line driving circuit 200, and generates the Y transfer start pulse DY, and the Y clock signal YCK, and supplies the signals to the scanning line driving circuit 100. The D/A converter 900 converts the supplied video center voltage Dref into an analog signal, and supplies the signal to the data line driving circuit 200 as the image signal VID. The video center voltage Dref is sequentially supplied to each pixel electrode 6 from the data line driving circuit 200 at a timing which is defined by the above described X transfer start pulse DX or the X clock signal XCK, the Y transfer start pulse DY or the Y clock signal YCK.

In the image display period, it is controlled so that the internal vertical synchronizing signal Vs2 is not generated and the external vertical synchronizing signal Vs1 is provided to the timing control circuit 800 as the panel output signal Vs3 through the selection circuit SW2, the external horizontal synchronizing signal Hs1 is provided to the timing control circuit 800 as the panel output signal Hs3 through the selection circuit SW3, and the digital image signal Din is provided to the D/A converter 900 through the selection circuit SW1. In this manner, an image (imaged image) which is provided from the CPU 15 of the camera is displayed on the liquid crystal panel AA of the EVF 20.

In this manner, in the ON sequence, it is possible to shorten a period which is necessary for initialization since the initialization process of the liquid crystal panel AA is performed using the internal vertical synchronizing signal Vs2 instead of the external vertical synchronizing signal Vs1. As a result, a period until an image is displayed after the start up of a power supply is shortened.

Subsequently, a supply timing of the vertical synchronizing signal in the OFF sequence will be described with reference to FIG. 7. As illustrated, when the display control signal Cdi is switched to an L level from an H level (t5), an image display period is ended, and an initialization process is started. In the initialization period, similarly to the case of the above described ON sequence, the internal vertical synchronizing signal Vs2 is generated, and is supplied to the timing control circuit 800 as the panel output signal Vs3 through the selection circuit SW2. When the initialization period is ended (t6) by performing writing with respect to the entire image display region A based on the plurality of internal vertical synchronizing signals Vs2, a supply of power to the liquid crystal panel AA is stopped, and the power supply is started down (t7).

That is, when the display control signal Cdi is switched to the L level from the H level (t5), the control circuit 600 performs a third process in which it is controlled so that the liquid crystal panel AA is driven based on the internal vertical synchronizing signal Vs2 which is supplied from the internal synchronizing signal generation circuit 500, and the video center voltage Dref is applied to each pixel electrode 6 of the liquid crystal panel AA. The control circuit 600 performs the third process every time the internal vertical synchronizing signal Vs2 is output. That is, the control circuit 600 repeatedly performs the third process with respect to the plurality of internal vertical synchronizing signals Vs2. In addition, when the initialization period ends (t6), it is controlled so that supplying of power to the liquid crystal panel AA from the power generation circuit 700 is stopped.

In this manner, since the initialization process of the liquid crystal panel AA is performed using the internal vertical synchronizing signal Vs2 instead of the external vertical synchronizing signal Vs1 also in the OFF sequence, a time which is necessary for initialization is shortened. As a result, it is possible to shorten the time until the power supply to the liquid crystal panel AA is started down after ending of the display of the image.

As described above, according to the embodiment, it is possible to perform a quick image display on the liquid crystal panel AA according to a detection of a start of a use of the EVF 20, and to improve convenience for a user. In addition, since it is possible to perform a quick stop of supplying of power to the liquid crystal panel AA according to a detection of a non-use state of the EVF 20, it is possible to suppress power consumption, and to contribute to the extending of a battery drive time.

Second Embodiment

FIG. 8 is a block diagram which illustrates an example of a configuration of an electronic viewfinder (EVF) 20A according to a second embodiment of the present invention.

In the above described first embodiment, the video center voltage Dref is applied to each pixel circuit through the data line driving circuit 200, however, the second embodiment is different from the first embodiment in that a precharge voltage Vpre is applied through a precharge circuit 300, not the data line driving circuit 200.

As illustrated in FIG. 8, the EVF 20A has the same configuration as that of the EVF 20 in the first embodiment, except for a point that the EVF 20A includes the precharge circuit 300, and a point that the EVF 20A does not include the selection circuit SW1. For this reason, the same reference numerals will be attached with respect to the same configurations in the first embodiment, and descriptions thereof will be omitted.

The precharge circuit 300 is arranged on the side opposite to the data line driving circuit 200 by interposing the image display region A therebetween, and applies the precharge voltage Vpre to each pixel electrode 6 based on the Y transfer start pulse DY and the Y clock signal YCK which are supplied from the timing control circuit 800 to the scanning line driving circuit 100, and a control signal Cpre which is supplied to the precharge circuit 300 from the timing control circuit 800. The precharge voltage Vpre is set to a voltage of which a potential difference between the pixel electrode 6 and the counter electrode becomes zero, similarly to the video center voltage Dref.

FIG. 9 is a timing chart (in case of ON sequence) for describing a supply timing of the vertical synchronizing signal according to the embodiment. As illustrated, when the display control signal Cdi is switched to an H level from an L level (t1), and the power supply start up period of the liquid crystal panel AA is ended (t2), the control signal Cpre is switched to an H level under a control of the control circuit 600. Similarly to the above described first embodiment, the internal vertical synchronizing signal Vs2 is generated in the initialization period, and the signal is supplied to the timing control circuit 800 as the panel output signal Vs3 through the selection circuit SW2. According to the embodiment, the precharge voltage Vpre is applied to each pixel electrode 6 from the precharge circuit 300 based on the internal vertical synchronizing signal Vs2 while the control signal Cpre is an H level.

In a period in which the control signal Cpre is the H level, an output terminal of the data line driving circuit 200 becomes high impedance. In the period, the precharge voltage Vpre is supplied to all of the data lines 3 from the precharge circuit 300.

Though it is not illustrated, also in the case of the OFF sequence, the control signal Cpre becomes an H level in the initialization period (periods of t5 to t6 in FIG. 7), and the precharge voltage Vpre is applied to each pixel electrode 6 from the precharge circuit 300 based on the internal vertical synchronizing signal Vs2.

According to the embodiment, it is possible to obtain the same effect as that in the above described first embodiment.

Modification Example

The present invention is not limited to the above described embodiment, and can be subjected to various modifications which will be described below. In addition, each embodiment and each modification example can be appropriately combined.

(1) According to the embodiment, a so-called point sequential configuration in which voltages corresponding to gradation are sequentially written in pixels corresponding to a scanning line 2 in a certain row, from the first column to the nth column, by sequentially sampling data signals of the first column to the nth column is adopted, however, it may be a configuration in which a so-called phase expansion (also referred to as serial-parallel conversion) driving in which a data signal is expanded on a time axis by r (r is an integer of 2 or more) times, and is supplied to r image signal lines, is used together, and may be a so-called line sequential configuration in which data signals are collectively supplied to all of data lines 3.

(2) In the above described embodiment and modification example, a case in which a frequency of the internal vertical synchronizing signal Vs2 is constant has been described, however, the frequency may be variable. For example, in the initialization period in the ON sequence, the frequency of the internal vertical synchronizing signal Vs2 may be monotonously decreased in order to be close to the frequency of the external vertical synchronizing signal Vs1, and in the OFF sequence, the frequency of the internal vertical synchronizing signal Vs2 may be monotonously increased from the frequency which is close to the frequency of the external vertical synchronizing signal Vs1 after ending a display on a screen. Alternatively, the frequency of the internal vertical synchronizing signal Vs2 may be increased or decreased according to a rule. According to the embodiment, since a horizontal scanning period of a predetermined voltage is differentiated in each field in the initialization period, a predetermined voltage is reliably applied in a relatively long horizontal scanning period, and on the other hand, a time which is necessary for the initialization process is shortened by providing a short horizontal scanning period.

(3) In addition, in the above described embodiment, as an example of an imaging apparatus, there is a video camera, a head mounted display, binoculars, or the like including an EVF, in addition to the digital camera which has been described. It goes without saying that it is possible to apply the driving control device according to the present invention to these various imaging apparatuses.

(4) In addition, it is based upon the premise that the liquid crystal panel AA is used in the embodiment and the modification example, however, the present invention is not limited to this, and it is possible to apply the present invention to a display panel in which it is preferable to perform the initialization process between the power ON and the image display, or between ending of the image display and the power OFF. For example, the liquid crystal panel may be an organic EL panel in which an organic electroluminescence (EL) is used as an electro-optical substance of which optical characteristics are changed due to electrical energy.

A pixel of the organic EL panel includes an organic EL element and a driving transistor which supplies a current to the organic EL element. The current which flows in the organic EL element is determined by a gate voltage of the driving transistor. For this reason, it is preferable to set the gate voltage to a predetermined voltage in the initialization process.

That is, the present invention can be applied to an electro-optical panel including an electro-optical substance such as the liquid crystal panel AA or the organic EL panel.

REFERENCE SIGNS LIST

1 Digital camera (imaging apparatus)
2 Scanning line
3 Data line
6 Pixel electrode
14 Sensor
15 CPU (External vertical synchronizing signal supply unit)
20 EVF
100 Scanning line driving unit
200 Data line driving circuit
300 Precharge circuit
500 Internal synchronizing signal generation circuit (Internal vertical synchronizing signal supply unit)
600 Control circuit (Control unit)
700 Power generation circuit (Power supply unit)
800 Timing control circuit
900 D/A converter
300 Precharge circuit
310 Photodiode
320 Capacitor
330 Switching element
AA Liquid crystal panel
Cdi Display control signal
D Driving control device
Dref Video center voltage (predetermined voltage)
P1 Pixel circuit
SW1, SW2, SW3 Selection circuit
Vs1 External vertical synchronizing signal
Vs2 Internal vertical synchronizing signal

The invention claimed is:

1. A driving control device of an electro-optical panel which controls driving of the electro-optical panel based on an external vertical synchronizing signal which is supplied from outside, the device comprising:

a power supply unit which supplies power to the electro-optical panel;

an internal vertical synchronizing signal supply unit which generates an internal vertical synchronizing signal of which a frequency is higher than that of the external vertical synchronizing signal, and outputs the internal vertical synchronizing signal; and a control unit, wherein, when a display control signal which instructs displaying of an image on the electro-optical panel is supplied, the control unit performs a first process in which it is controlled so that power is supplied to the electro-optical panel from the power supply unit, and a second process in which it is controlled so that the electro-optical panel is driven based on the internal vertical synchronizing signal, and in which a predetermined voltage is applied to each pixel electrode of the electro-optical panel in the second process, and after repeatedly performing the second process, the electro-optical panel is driven based on the external vertical synchronizing signal, and wherein the first process is a power supply start up process which is performed when the display control signal is changed from a low level to a high level.

2. The driving control device of an electro-optical panel according to claim 1, wherein the frequency of the internal vertical synchronizing signal is equal to or greater than ten times, or equal to or smaller than twenty times that of the external vertical synchronizing signal.

3. The driving control device of an electro-optical panel according to claim 2, wherein the frequency of the internal vertical synchronizing signal is variable.

4. The driving control device of an electro-optical panel according to claim 1, wherein the frequency of the internal vertical synchronizing signal is variable.

5. The driving control device of an electro-optical panel according to claim 1, wherein the predetermined voltage is a voltage in which a potential difference between each of the pixel electrode and a counter electrode thereof becomes zero.

6. The driving control device of an electro-optical panel according to claim 1, wherein a precharge circuit is connected to the electro-optical panel, and wherein in the second process, the control unit applies the predetermined voltage to all of the pixel electrodes of the electro-optical panel at the same time from the precharge circuit.

7. An electro-optical device comprising:

an electro-optical panel; and the driving control device of an electro-optical panel according to claim 1.

8. The electro-optical device according to claim 7, wherein the frequency of the internal vertical synchronizing signal is equal to or greater than ten times, or equal to or smaller than twenty times that of the external vertical synchronizing signal.

9. An imaging apparatus which includes an electronic viewfinder, the apparatus comprising:

an electro-optical panel which is provided in the electronic viewfinder, and displays an imaged image using the imaging apparatus;

the driving control device of an electro-optical panel according to claim 1 which is used in driving of the electro-optical panel;

an external vertical synchronizing signal supply unit which supplies the external vertical synchronizing signal to the driving control device in synchronization with data of the imaged image; and a sensor which detects a use state or a non-use state of the electronic viewfinder, wherein the display control signal is a detection signal of the sensor, instructs displaying of an image on the electro-optical panel when the detection signal detects use of the electronic viewfinder, and instructs ending of the display of the image on the electro-optical panel when the detection signal detects non-use of the electronic viewfinder.

10. A driving control device of an electro-optical panel which controls driving of the electro-optical panel based on an external vertical synchronizing signal which is supplied from outside, the device comprising:

a power supply unit which supplies power to the electro-optical panel;

an internal vertical synchronizing signal supply unit which generates an internal vertical synchronizing signal of which a frequency is higher than that of the external vertical synchronizing signal, and outputs the internal vertical synchronizing signal; and a control unit, wherein, when a display control signal which instructs ending of a display of an image on the electro-optical panel is supplied in a case in which a driving unit performs a control so that the electro-optical panel is driven based on the external vertical synchronizing signal, the control unit repeats a third process, in which the electro-optical panel is controlled so as to be driven based on the internal vertical synchronizing signal and in which a predetermined voltage is applied to each pixel electrode of the electro-optical panel in the third process, with respect to a plurality of the internal vertical synchronizing signals, and performs a control so that supplying of power to the electro-optical panel from the power supply unit is stopped thereafter.

11. The driving control device of an electro-optical panel according to claim 10, wherein the frequency of the internal vertical synchronizing signal is equal to or greater than ten times, or equal to or smaller than twenty times that of the external vertical synchronizing signal.

12. The driving control device of an electro-optical panel according to claim 11, wherein the frequency of the internal vertical synchronizing signal is variable.

13. The driving control device of an electro-optical panel according to claim 10, wherein the frequency of the internal vertical synchronizing signal is variable.

14. The driving control device of an electro-optical panel according to claim 10, wherein the predetermined voltage is a voltage in which a potential difference between each of the pixel electrode and a counter electrode thereof becomes zero.

15. The driving control device of an electro-optical panel according to claim 10, wherein a precharge circuit is connected to the electro-optical panel, and wherein in the second process, the control unit applies the predetermined voltage to all of the pixel electrodes of the electro-optical panel at the same time from the precharge circuit.

16. An electro-optical device comprising:

an electro-optical panel; and the driving control device of an electro-optical panel according to claim 10.

17. The electro-optical device according to claim 16, wherein the frequency of the internal vertical synchronizing signal is equal to or greater than ten times, or equal to or smaller than twenty times that of the external vertical synchronizing signal.

18. An imaging apparatus which includes an electronic viewfinder, the apparatus comprising:

an electro-optical panel which is provided in the electronic viewfinder, and displays an imaged image using the imaging apparatus;

the driving control device of an electro-optical panel according to claim 2 which is used in driving of the electro-optical panel;

an external vertical synchronizing signal supply unit which supplies the external vertical synchronizing signal to the driving control device in synchronization with data of the imaged image; and a sensor which detects a use state or a non-use state of the electronic viewfinder, wherein the display control signal is a detection signal of the sensor, instructs displaying of an image on the electro-optical panel when the detection signal detects use of the electronic viewfinder, and instructs ending of the display of the image on the electro-optical panel when the detection signal detects non-use of the electronic viewfinder.

19. A driving control method of an electro-optical panel which controls driving of the electro-optical panel based on an external vertical synchronizing signal which is supplied from outside, the method comprising:

performing a first process in which it is controlled so that power is supplied to the electro-optical panel, and a second process in which it is controlled so that the electro-optical panel is driven based on the internal vertical synchronizing signal of which the frequency is higher than that of the external vertical synchronizing signal, and in which a predetermined voltage is applied to each pixel electrode of the electro-optical panel in the second process when a display control signal which instructs displaying of an image on the electro-optical panel is supplied, and after repeatedly performing the second process, performing a control so that the electro-optical panel is driven based on the external vertical synchronizing signal, wherein the first process is a power supply start up process which is performed when a display control signal is changed from a low level to a high level.

20. A driving control method of an electro-optical panel which controls driving of the electro-optical panel based on an external vertical synchronizing signal which is supplied from outside, the method comprising:

repeating a third process of controlling so that the electro-optical panel is driven based on an internal vertical synchronizing signal of which a frequency is higher than that of the external vertical synchronizing signal and controlling so that a predetermined voltage is applied to each pixel electrode of the electro-optical panel in the third process, with respect to a plurality of the internal vertical synchronizing signals, and performing a control so that supplying of power to the electro-optical panel is stopped thereafter, when a display control signal which instructs ending of a display of an image on the electro-optical panel is supplied, in a case in which a control is performed so that the electro-optical panel is driven based on the external vertical synchronizing signal.

* * * * *